US005661865A

United States Patent [19]

Humphrey

[11] Patent Number: 5,661,865

[45] Date of Patent: Sep. 2, 1997

[54] CLEANER FOR PAINT ROLLERS

[76] Inventor: Glyn W. Humphrey, 3309 Springcrest Dr., Louisville, Ky. 40241

[21] Appl. No.: 582,577

[22] Filed: Jan. 3, 1996

[51] Int. Cl.[6] ..... B08B 3/04; B05C 21/00

[52] U.S. Cl. ..... 15/3; 15/104.92; 15/236.03; 134/900; 206/15.3; 206/361; 401/122

[58] Field of Search ..... 15/1, 3, 236.03, 15/104.92, 257.01, 257.06, 260, 104.001; 134/900; 206/15.2, 15.3, 361; 401/122

[56] References Cited

U.S. PATENT DOCUMENTS

| | | | |
|---|---|---|---|
| 2,819,483 | 1/1958 | MacAulley | 15/104.92 |
| 2,983,938 | 5/1961 | Veazey | 15/257.06 |
| 3,431,574 | 3/1969 | Mathieu | 15/104.92 |
| 3,608,120 | 9/1971 | Seiler | 15/104.92 X |
| 3,688,735 | 9/1972 | Stevens et al. | 134/138 |
| 3,707,740 | 1/1973 | Demers . | |
| 4,320,550 | 3/1982 | McGrew | 15/104.92 X |
| 4,334,416 | 6/1982 | Turano | 68/213 |
| 4,467,533 | 8/1984 | Sica | 206/361 X |
| 4,533,044 | 8/1985 | Ban | 206/362 |
| 4,738,358 | 4/1988 | Kehl | 206/361 X |
| 4,995,749 | 2/1991 | Gornik | 401/9 |
| 5,402,808 | 4/1995 | Wallis et al. . | |
| 5,496,412 | 3/1996 | Ahmad | 15/104.92 X |
| 5,515,567 | 5/1996 | Washburn | 15/3 |
| 5,533,617 | 7/1996 | Von Flatern | 206/361 |

FOREIGN PATENT DOCUMENTS

| | | | |
|---|---|---|---|
| 8301131 | 10/1984 | Netherlands | 15/104.92 |
| 793180 | 4/1958 | United Kingdom | 401/122 |

*Primary Examiner*—Mark Spisich

*Attorney, Agent, or Firm*—Polster, Lieder, Woodruff & Lucchesi

[57] ABSTRACT

A cleaner for cleaning the compressible media portion of a fluid transfer member including an apertured liquid holding receptacle, the aperture of which is provided with a flexible rim adapted to compress the media portion therefrom when passed therethrough.

14 Claims, 3 Drawing Sheets

CLEANER FOR PAINT ROLLERS

BACKGROUND OF THE INVENTION

Present invention relates to a unique arrangement for cleaning the compressible portion of a fluid transfer member and more particularly to a unique and novel structural arrangement and modification thereof for cleaning compressible paint roller applicators.

Numerous structural arrangements have been proposed in the past for cleaning paint rollers. These past arrangements can be classified as falling under one of three general categories, namely: (a) a liquid tank for receiving a paint roller to be cleaned including spray apparatus to be directed against a paint roller to be cleaned; (b) an annular spray ring with the spray directed against a paint roller periphery with relative motion being provided between annular spray and roller along the longitudinal axis of the paint roller; and (c) an annular scraping ring capable of exerting pressure against the periphery of a paint roller during relative motion between paint roller and scraper along the longitudinal axis of the paint roller. Numerous features of category (a) including tank and paint roller spray, for example, can be found in a number of U.S. Pat. No., such as No. 3,688,785, issued to Jackson B. Stevens et al on Sep. 5, 1972; No. 4,334,416, issued to Peter S. Turano on Jun. 15, 1982; No. 4,533,044, issued to Thomas E. Ban on Aug. 6, 1985; and, No. 4,738,358, issued to Charles W. Kehl on Apr. 19, 1988. Features of category (b), including an annular spray moveable relative the longitudinal axis of a paint roller, can be found in a number of U.S. patents, such as U.S. Pat. No. 4,995,749, issued to Robert J. Gornik on Feb. 26, 1991; and, No. 5,402,808, issued to Scott D. Wallis on Apr. 4, 1995. Features of category (c), including an annular scraper device moveable relative the longitudinal axis of a paint roller, can be found in U.S. Pat. No. 3,707,740, issued to Romeo J. N. Demers on Jan. 2, 1973.

For the most part, paint roller cleaner arrangements like those above described have been comparatively complex in construction, operation and maintenance, often with undesirable spray control and messy staining involved.

The present invention provides a unique, straight-forward and economical paint roller cleaner construction which not only is economical and efficient in construction, operation and maintenance, requiring a minimum of parts and a minimum of energy in operation and maintenance, but which also is environmentally compatible, minimizing undesirable spray and concomitant messy staining from prior art spraying. In a single unit, the present invention provides for efficient cleaning and storage, the single Unit being readily adaptable to the cleaning of other shaped fluid transfer devices besides paint rollers. For example, it would be possible, by a mere change of media compression means configuration, to utilize the same single unit for cleaning fluid transfer mechanisms such as floor mops and paint brushes.

Various other features of the present invention will become obvious to one skilled in the art upon reading the disclosure set forth herein.

BRIEF SUMMARY OF THE INVENTION

More particularly the present invention provides an apparatus for cleaning a compressible portion of a fluid transfer member comprising: a fluid receptacle means sized to contain the compressible portion of the fluid transfer member, the fluid receptacle means including an associated aperture sized to allow the compressible portion of the fluid transfer means to pass therethrough into and out of the fluid receptacle means; the associated aperture including a flexible rim means surrounding the periphery thereof sized to compress the compressible portion of the fluid transfer means to extract liquid therefrom when passed therethrough; and, an actuator means connectible to the fluid transfer member to move the compressible portion of the fluid transfer member through the flexible rim means. The present invention also provides a modified paint roller frame construction particularly compatible with features of the present invention. In addition, the present invention provides a modified receptacle arrangement including separate chambers with one chamber serving to accommodate the compressible portion of the treated fluid transfer member and the other chamber serving to accommodate liquid extracted from the compressible portion of the fluid transfer member when it is inserted into the fluid receptacle means. Further, the present invention provides a unique receptacle cover arrangement to guide extracted fluid into one of the two separate chambers.

It is to be understood that various changes can be made by one skilled in the art in one or more of the several parts of the embodiments disclosed herein without departing from the scope or spirit of the present invention. For example, the flexible rim means can be readily changed to be other than of annular shape, depending upon the nature and shape of the fluid transfer means—which can include paint brushes and mops. It also would be possible to fasten the compression lips to the receptacle cover and the receptacle cover to the receptacle with any one of several known fastening devices different from that shown.

BRIEF DESCRIPTION OF THE DRAWINGS

Referring to the drawings which disclose one advantageous embodiment of the present invention and a modification thereof.

DETAILED DESCRIPTION OF THE INVENTION

Figure 2:
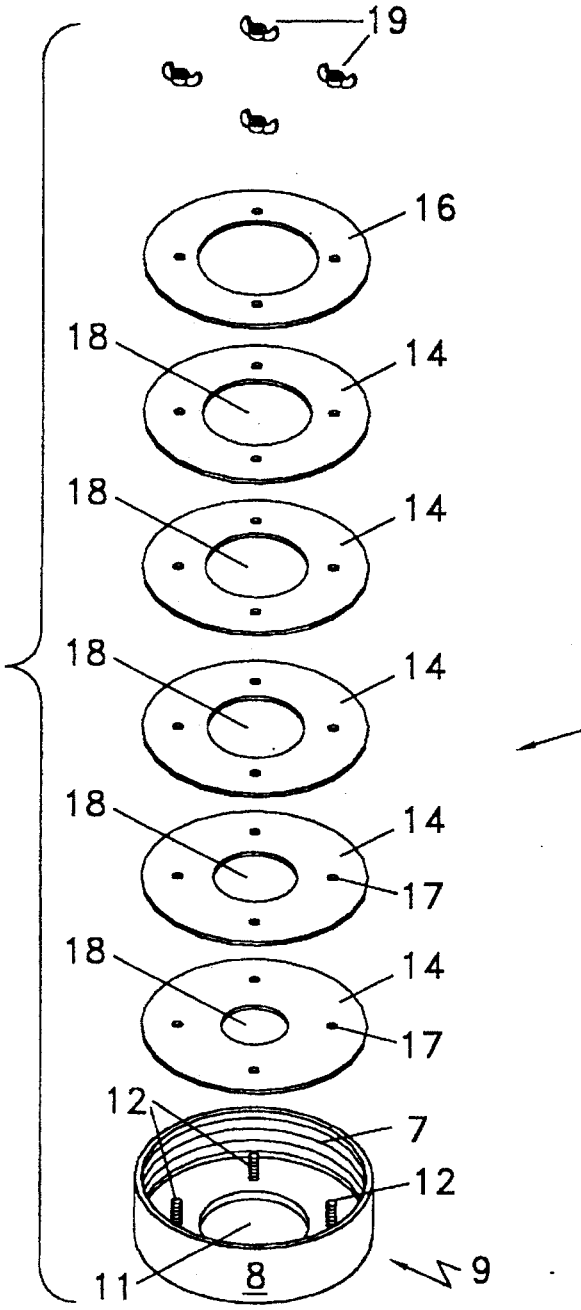
FIG. 2 is an exploded, isometric view of the bottom face of the cylindrical receptacle cover of FIG. 1, disclosing several flexible rings fastened thereto to form a compressing peripheral lip portion extending around the periphery of the central aperture in the receptacle cover.
Figure 1:
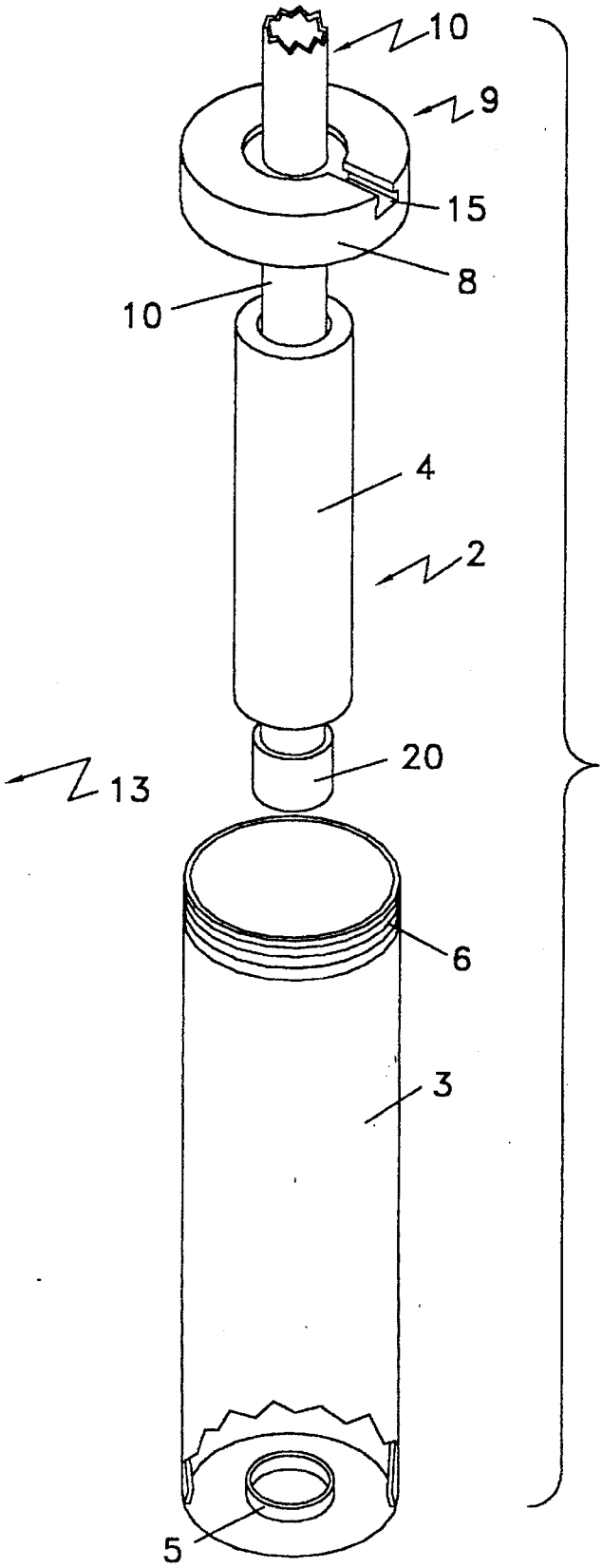
FIG. 1 is an exploded, partially broken away, isometric, partial view of a cylindrical, longitudinally extending paint roller cleaner disclosing certain of the novel features of the present invention.
Figure 3:
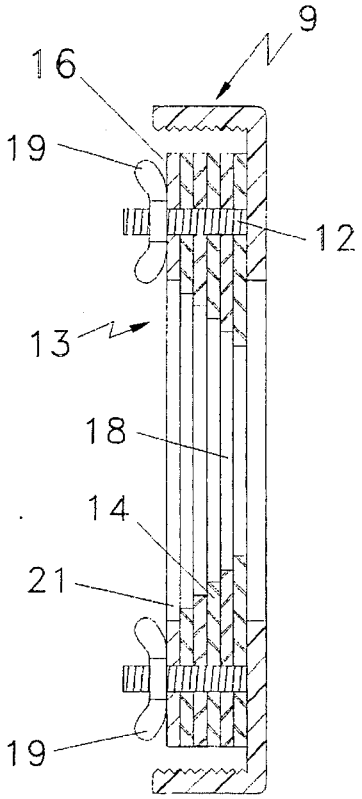
FIG. 3 is a cross-sectional, side view of the cover, compressing rings and back-up plate of FIG. 1.

Referring to FIGS. 1–3 of the drawings, a novel paint roller cleaner assembly 2 is shown as including a longitudinally extending, cylindrical, fluid receptacle 3. Advantageously, fluid receptacle 3 can be transparent and advantageously can be formed from glass or some other suitable substantially rigid or stiff corrosion resisting, transparent, plastic material. Receptacle 3 is appropriately sized to contain a paint cleaning solvent and a compressible, longitudinally extending paint roller 4, shown in FIG. 1 as positioned thereabove. Centrally and fixedly disposed at the bottom of fluid receptacle 3 is an actuator guide ring 5 to hold rod-like actuator and roller 4 in a vertical position during storage. It is to be noted that fluid receptacle 3 can be provided with external threads along the upper exterior surface thereof so as to matingly engage with internal threads 7 provided on the peripheral lip portion 8 of cylindrical receptacle cover 9 to hold cover 9, which cover can be formed from a suitable plastic material, firmly in place on fluid receptacle 3. It further is to be noted that cover 9 can be provided with an indentation or recess 15 to provide a resting place for rod-like actuator 10, the recess 15 being sized for snap-fit engagement with a portion of actuator 10. It is to be understood that the present invention is not to be considered as limited to the threaded fastening means as shown for receptacle 3 an cover 9, but that other fastener arrangements can also be employed for maintaining cover 9 in releasable relation with fluid receptacle 3.

As can be particularly seen in FIG. 2, cover 9 has a centrally disposed circular aperture 11 therein. This aperture 11 Can be so sized as to allow paint roller 4 to pass longitudinally therethrough into and out of receptacle 3. Cover 9 further includes a plurality of integral, spaced, threaded studs 12 extending from the bottom inner under face thereof in surrounding relation to the periphery of central aperture 11 to be between the periphery of the aperture 11 and the peripheral lip 8 of cylindrical cover 9.

A flexible annulus assembly 13, including a preselected number of paint roller annular compressing rings 14 and a rigid plastic or metallic back-up plate 16 are provided with appropriately spaced stud receiving holes 17, which correspond in spacing with and can be aligned to engage with the spaced studs 12, to permit under cover mounting of rings 14 and back-up plate 16 on the threaded studs 12. It is to be noted that rings 14 and back-up plate 16 successively define apertures 18, which can be of increasing diameter so that when the rings 14 and plate 16 are mounted on threaded studs 12 to be held in place by threaded wing nuts 19, the stack collectively defines a stepped, truncated peripheral wall 21 surrounding the periphery of central aperture 11 in cover 9. It also is to be noted in the embodiment of the invention as disclosed in FIGS. 1–3 that such stepped, truncated peripheral wall 21 slopes inwardly toward the compression line of movement of paint roller 4 from a liquid solvent bath in fluid receptacle 3, through compressing flexible annulus assembly 13, formed by stacked flexible rings 14, roller 4 being in substantially compressed, liquid free state outside of—or ambient—relative the liquid receptacle 3. The compressible paint roller 4 thus can be wrung to a comparatively dry state by the flexible annulus assembly 13 with compressed liquid remaining in fluid receptacle 3 along with any previously introduced paint solvent. It is to be understood that stacked rings 14 can vary in number, can vary or be the same in aperture size and can be formed from a suitable rubber or plastic material having a preselected modulus of elasticity with preselected properties which are resistant to both paint and liquid solvent, allowing ready manual manipulation and, at the same time, accomplishing the desired wringing function.

In a typical operation of the embodiment of the invention as disclosed in FIGS. 1–3 of the drawings, the rod-like paint roller actuator 10 of FIG. 1 is used to pull paint roller 4 through the center aperture of back-up plate 16, paint roller annular compressing rings 14, and the center aperture in cover 9. Paint roller actuator 10 can be formed or constructed of rigid plastic, metal or other suitable material and is sized in length to extend through the center aperture of cover 9 and to engage with guide ring 5 at the bottom of receptacle 3. This sizing of actuator 10 can also be such so as to provide a gripping surface at the upper portion of the actuator 10 to allow for extraction of paint roller 4 from receptacle 3 through the center aperture of back-up plate 16, paint roller annular compressing rings 14, and the center aperture cover 9. The outside diameter of the upper portion of the rod-like actuator 10 is of a size to allow longitudinal insertion into the longitudinally extending hollow center of paint roller 4 as shown in FIG. 1. The outside diameter of the lower section of the rod-like actuator 10 can be provided with collar 20 so paint roller 4 will not slip off of rod-like actuator 10 during extraction of paint roller 4 from receptacle 3 through the aligned central apertures of back-up plate 16, paint roller annular compressing rings 14, and the central aperture of cover 9. It is again to be noted that actuator 10 is of sufficient length to allow insertion of collar 20 into actuator guide ring 5 at the bottom of receptacle 3. Also, it is to be noted that the lower portion of the rod-like actuator 10 and the collar 20 are of sufficient length to support the lower extremity of paint roller 4 in spaced relation to the inner bottom surface of receptacle 3 during storage.

Figure 4:
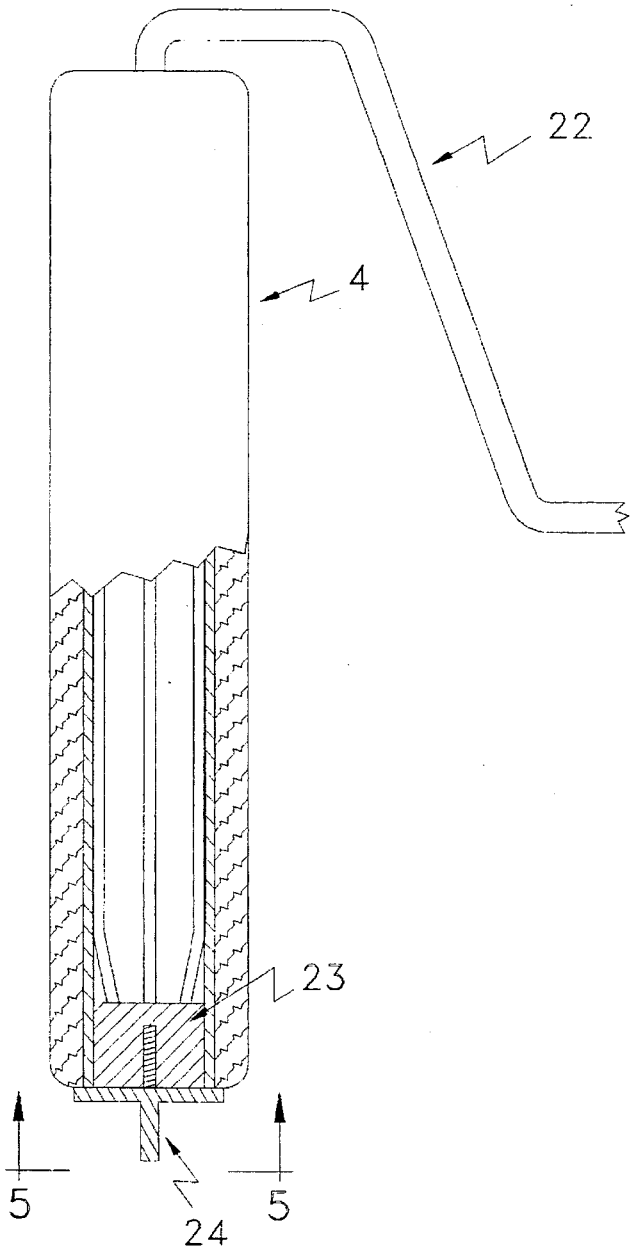
FIG. 4 is a partial cross-sectional, side view of a paint roller, paint roller frame and handle portion showing a modified adapter to current paint roller frame structure to enhance use with the present inventive structure.
Figure 5:
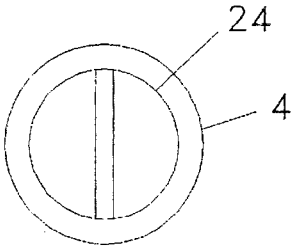
FIG. 5 is an end view of the adapter of FIG. 4 taken in a plane through line 5—5 of FIG. 4.

Referring particularly to FIGS. 4 and 5 of the drawings, it is to be noted that paint roller frame 22, similar to those presently available in the marketplace, can be modified to allow its use as a paint roller actuator for the purpose of storing paint roller 4 in receptacle 3 and extracting paint roller 4 from receptacle 3 through the central apertures of back-up plate 16, paint roller annular compressing rings 14, and cover 9 without removing the paint roller 4 from paint roller frame 22 and associated handle. End cap 23 is as currently manufactured by paint roller frame manufacturers with the exception that it is of sufficient length to snugly (or threadedly) engage with the extremity of the hollow longitudinally extending center of paint roller 4, the end cap 23 also including a threaded center aperture which serves to receive an external end grip, spacer, and guide in the form of thumb screw stop 24, which can be constructed of rigid plastic or other suitable material. Thumb screw stop 24 can be screwed into threaded center aperture of end cap 23, the stop 24 having an outside diameter slightly larger than the inside diameter of paint roller 4 to prevent slippage of paint roller 4 from paint roller frame 22 during extraction of paint roller 4 from receptacle 3 through the central aperture of back-up plate 16, paint roller annular compressing rings 14, and cover 9. The distal end of stop 24 is sized to nest in guide 5 at the bottom of receptacle 3 spacing roller 4 from the bottom of the receptacle. The central apertures of back-up plate 16, paint roller compressing rings 14, and cover 9 can be moved longitudinally along paint roller frame 22 and an associated handle (not shown) for subsequent fastening of apertured cover 9 to receptacle 3 for storage and/or extraction. During storage, a portion of paint roller frame 22 can be nested into support notch 15 to secure paint roller frame 22, paint roller frame handle, and roller 4 to cover 9.

Figure 6:
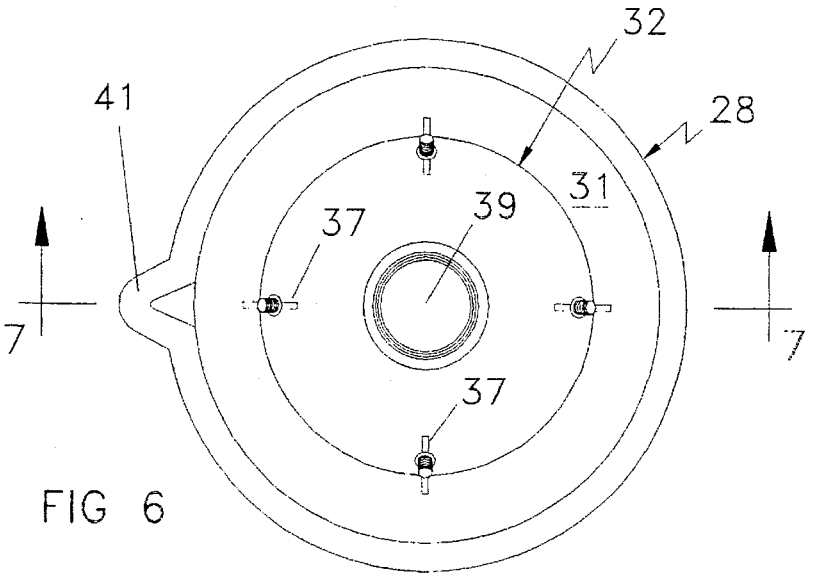
FIG. 6 is a plan view of the inside cover of a further modified embodiment of a paint roller cleaner of the present invention; and, FIG. 7 is a cross-sectional side view of the paint roller cleaner of FIG. 6, taken in plane through line 7—7 of FIG. 6.
Figure 7:
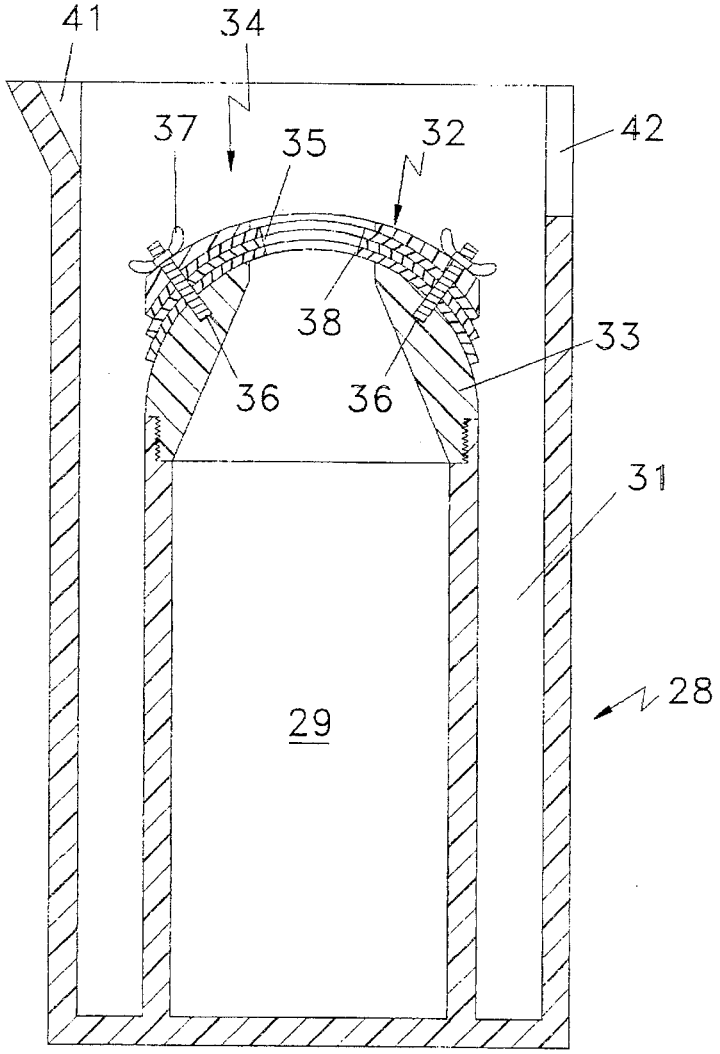

Referring to FIGS. 6 and 7 of the drawings, a modified fluid receptacle 28 can be seen. This receptacle, which also can be of cylindrical shape, includes an inner comparatively dry chamber 29 surrounded by a longitudinally extending wet annular outer chamber 31 which is radially spaced from cylindrical chamber 29 by the surrounding cylindrical wall of chamber 29. A cylindrical cover 32, which also can be of plastic is provided with threads at the lip portion 33 to fastenly engage threads at the upper open end of dry chamber 29. Cover 32 which serves to cover dry chamber 29, includes a domed or conical outer face configuration which slopes downwardly to the peripheral lip portion 33 thereof. It is to be noted that a sloping flexible annulus assembly 34, similar to flexible annulus assembly 13 above described, but having a preselected number of only three annular rings 35, is provided for cover 32 and is held in place by threaded studs 36 projecting from lip portion 33 and wing nuts 37. Flexible annulus assembly 34, like flexible annulus assembly 13, is comprised of stacked annular rings 35 as above described. However, stacked rings 35 have the apertures thereof so sized that the truncated peripheral wall 38 formed thereby slopes downwardly and inwardly from the outer face of cover 32 whereby liquid is compressively removed from a paint roller as it is moved by an actuator into comparatively dry receptacle chamber 29 with the removed liquid flowing into the wet annular surrounding outer chamber 31. It further is to be noted that outer chamber 31 can be provided with a suitable pour spout 41 on the outer wall thereof and the outer face can include radial spaced channels to direct liquid into wet chamber 31 and a frame nesting groove or recess 42 similar to nesting groove or recess 15 aforedescribed.

It is to be understood that the flexible annulus as disclosed can be so modified as to provide an aperture which is shaped in the form of a longitudinally extended slot which can particularly be sized and adapted to conform with and to compress paint brush and/or mop media.

The invention claimed is:

1. An apparatus for cleaning a compressible portion of a fluid transfer member comprising:

an elongated and longitudinally extending fluid receptacle means having opposite first and second ends and an inner peripheral wall sized to contain a paint receiving and cleaning solvent and maintain said compressible portion of said fluid transfer member in spaced relation from said inner peripheral wall, said fluid receptacle means including an associated receptacle aperture extending inwardly from said inner peripheral wall at one end thereof and sized to allow said compressible portion of said fluid transfer member to pass therethrough into and out of said fluid receptacle means in spaced relation to said inner peripheral wall;

said associated receptacle aperture extending inwardly from said inner peripheral wall adjacent one end thereof including an apertured flexible rim means surrounding and including means for removably fastening the flexible rim means to said fluid receptacle means and sized to flexibly and fully contact to compress the compressible portion of said fluid transfer member to extract liquid therefrom when passed therethrough; and, an actuator means cooperable with said fluid transfer member to more said compressible portion of said fluid transfer member in either direction through said apertured flexible rim means.

2. The apparatus of claim 1, said flexible rim means being adapted to flexibly and fully contact to compress and extract fluid from said compressible portion of said fluid transfer member as the entirety of said fluid transfer member is withdrawn from said fluid receptacle means.

3. The cleaning apparatus of claim 1, said fluid receptacle means including guide means to guide and restrain movement of said fluid transfer member when inserted into said fluid receptacle means.

4. The cleaning apparatus of claim 1, said fluid receptacle means including first and second separate chambers, one accommodating said compressible portion of said fluid transfer member and the other accommodating fluid extracted from said compressible portion of said fluid transfer member, said apertured flexible rim means being adapted to compress and extract fluid from said compressible portion of said fluid transfer member when said fluid transfer member is inserted into said fluid receptacle means.

5. The cleaning apparatus of claim 1, said fluid receptacle means including a removable, centrally apertured cover member having said associated aperture aligned with said apertured flexible rim means disposed therein.

6. The cleaning apparatus of claim 5 said cover member including nesting means for a portion of said actuator means.

7. The cleaning apparatus of claim 1, said flexible rim means being comprised of stacked, flexible annular rings removably attached to said fluid receptacle means to surround the periphery of said associated aperture.

8. The cleaning apparatus of claim 7 and a rigid backing ring removably facing said stacked flexible rings.

9. The cleaning apparatus 7, said stacked, flexible annular rings successively defining apertures of preselected radii to collectively define a preselectively shaped peripheral wall surrounding the periphery of said associated receptacle aperture in said fluid receptacle means.

10. The cleaning apparatus of claim 9, said preselected peripheral wall defined by said stacked flexible rings, being truncated and so positioned to slope inwardly relative a defined axis of compressing motion of said actuator means through said flexible rim means.

11. The cleaning apparatus of claim 1, said receptacle means being sized to contain a liquid bath and a longitudinally extending paint roller.

12. An apparatus for cleaning a longitudinally extending compressible paint roller comprising:

a transparent longitudinally extending, substantially rigid, cylindrical fluid receptacle sized to contain a paint cleaning solvent and a compressible paint roller to be disposed therein, said cylindrical receptacle being provided with fixedly mounted, centrally disposed guide ring at a bottom inner face thereof to nestingly receive a distal extremity of said paint roller and with external threads along an upper surface thereof to threadedly engage with a receptacle cover therefor;

a cylindrical receptacle cover having an inner underface and having an internally threaded peripheral lip portion sized to matingly engage with the external threads of said fluid receptacle, said cover having an aperture centrally disposed therein sized to allow a longitudinally extending compressible paint roller to pass therethrough into and out of said receptacle, said cover including a plurality of spaced, threaded studs extending from a bottom, underface, portion thereof surroundingly disposed between the periphery of said aperture in said cover and said internally threaded peripheral lip portion;

a flexible annulus including a preselected number of paint roller compressing flexible rubber ring members and an annular, rigid back-up plate mounted on said threaded studs to be held firmly in place on said inner under face of said receptacle cover by a set of threaded wing nuts engagingly mating with said studs, said flexible rings successively defining apertures of preselected diameter to collectively define a preselectively shaped peripheral wall surrounding the periphery of said central aperture in said receptacle cover with said preselectively shaped peripheral wall sloping inwardly toward a compressing line of movement of said paint roller; and, a rod-like actuator for a paint roller, said rod-like actuator having positioned at a distal end thereof a support collar serving to support a distal end of a paint roller in spaced proximal relation to a base of said fluid receptacle and to nest with said guide ring at the bottom inner face of said receptacle, one of said receptacle and said cover including a nesting groove to engage with a portion of said rod-like actuator.

13. The cleaning apparatus of claim 12, said fluid receptacle including substantially rigid inner and surrounding outer radially spaced cylindrical chambers with said cylindrical cover cooperatively sized to engage and cover said inner chamber, said cover having an outer face in the configured shape of a dome sloping downwardly toward the peripheral lip portion thereof with said flexible annulus having said peripheral wall sloping downwardly and inwardly from an outer face of said cover whereby liquid is compressively removed from a paint roller as it is moved by said actuator into said receptacle with the removed liquid flowing into said outer chamber, said outer chamber having a liquid pour spout and nesting groove on the outer wall thereof.

14. The cleaning apparatus of claim 12, said support collar comprising an end cap insertably and threadedly engageable in the distal end of said paint roller.

* * * * *